US005133640A

United States Patent [19]

Groenendaal, Jr. et al.

[11] Patent Number: 5,133,640

[45] Date of Patent: Jul. 28, 1992

[54] THERMAL SHIELD FOR STEAM TURBINES

[75] Inventors: John C. Groenendaal, Jr., Winter Springs; David M. Parker, Oviedo, both of Fla.

[73] Assignee: Westinghouse Electric Corp., Pittsburgh, Pa.

[21] Appl. No.: 542,492

[22] Filed: Jun. 21, 1990

[51] Int. Cl.[5] ..... F01D 5/08

[52] U.S. Cl. ..... 415/177; 415/108

[58] Field of Search ..... 415/108, 134-136, 415/170.1, 175, 177, 178

[56] References Cited

U.S. PATENT DOCUMENTS

| | | | |
|---|---|---|---|
| 3,915,581 | 10/1975 | Brandstätter | 415/135 |
| 4,102,598 | 7/1978 | Stock et al. | 415/135 |
| 4,149,832 | 4/1979 | Sivolap et al. | 415/178 |
| 4,863,341 | 9/1989 | Groenendaal | 415/177 |
| 4,915,581 | 4/1990 | Groenendaal, Jr. et al. | 415/108 |

FOREIGN PATENT DOCUMENTS

| | | | |
|---|---|---|---|
| 0893452 | 4/1962 | United Kingdom | 415/108 |
| 0925957 | 5/1963 | United Kingdom | 415/108 |

*Primary Examiner*—Edward K. Look
*Assistant Examiner*—Christopher M. Verdier

[57] ABSTRACT

A thermal shield for a steam turbine inner cylinder surrounding a plurality of turbine blade stages and having an outer cylinder substantially enclosing the inner cylinder. A steam inlet is connected to the inner cylinder through an outer cylinder for admitting high temperature steam into the inner cylinder to effect rotation of the turbine blade stages and a steam exit emits cooled steam from the inner cylinder into a space between the inner and outer cylinders. The shield reduces thermal stress on the inner cylinder from contact on an inner surface with the high temperature steam and contact on an outer surface with the cooled steam. The thermal shield is attached to the outer surface of the inner cylinder and spaced therefrom by a predetermined spacing. The thermal shield extends about all surfaces of the inner cylinder and forms a substantially closed inner space between the shield and the inner cylinder to prevent the flow of the cooled steam over the outer surface of the inner cylinder.

10 Claims, 5 Drawing Sheets

THERMAL SHIELD FOR STEAM TURBINES

The present invention relates to steam turbines and, more particularly, to thermal shielding of inner cylinders of steam turbines.

BACKGROUND OF THE INVENTION

Thermal shielding is used in low pressure steam turbines to reduce through-wall and axial thermal gradients, associated thermal stresses and distortion, and to reduce heat losses to a condenser coupled to receive exhaust steam from the turbine. Such shielding is usually applied to an exterior surface of a turbine inner cylinder. Typically, such shielding covers only a cylindrical outer surface portion of the inner cylinder leaving flanges, bolting members, and the inner cylinder end walls exposed to the external steam environment, i.e., to low temperature steam in the turbine between the inner and outer cylinders. Thermal shielding is generally attached to the inner cylinder cylindrical surface portion by welding studs which are welded to the outer surface of the inner cylinder. Preferably, the welding studs have a tapped hole for receiving attaching screws passing through corresponding holes in the thermal shield. The shielding is generally a light gage of carbon steel, usually about 0.12 inches (3.048 mm) thick. The shielding is produced in many pieces or segments to allow fitting about complex geometries and to provide accessibility to inner cylinder bolting access covers.

Numerous problems may be possible with the above described design. If joints between segments of the thermal shield are not supported by the studs, pieces or sections of shielding may vibrate. Vibration may lead to cracking and structural failures in which part of the thermal shield may break loose causing consequential damage to the turbine condenser. Gaps between segments are sometimes sealed by welding narrow strips of material to the segment at one side of the gap. Due to vibration, erosion, and less than ideal weldability, these sealing strips may become detached, reducing the effectiveness of the thermal shield. Additional failures may result from loss of attachment screws The carbon steel plate of the shield is subject to corrosion and erosion due to the wet steam environment and this effect may be aggravated in turbine units with above average air inleakage leading to accelerated deterioration and thinning of the thermal shield plate.

Incomplete coverage of the inner cylinder outer surface, and poor sealing caused by gaps between the thermal shield and adjacent structures cause the effectiveness of the thermal shield to be diminished. The temperature gradients across the inner cylinder are therefore not reduced as much as desired and this may lead to excessive cylinder distortion and ovality, which may cause blade and seal rubs, and high stress levels in the cylinder structure and bolting members. This, in turn, may cause cylinder structural problems such as cracking of cylinder components, loss of thermal performance due to seal rubs at distorted cylinder sections, and leakage at highly stressed bolted joints. It may impair the thermal performance of the turbine by allowing excessive heat loss from the hot inner cylinder walls to the cold exhaust steam.

SUMMARY OF THE INVENTION

It is an object of the present invention to provide a method and apparatus for overcoming the above and other disadvantages of the prior thermal shielding of steam turbines.

It is a more specific object of the present invention to provide a method and apparatus which substantially encloses an inner cylinder of a low pressure steam turbine to reduce thermal stress on the inner cylinder.

It is yet another object of the present invention to provide a method and apparatus for attaching a thermal shield to an inner cylinder of a steam turbine so as to minimize a flow of reduced temperature steam over a surface of the inner cylinder.

The above and other objects are obtained in an improved thermal shield for an inner cylinder of a low pressure steam turbine in which the inner cylinder surrounds a plurality of turbine blade stages. An outer cylinder substantially encloses the inner cylinder and steam inlet means is connected to the inner cylinder through the outer cylinder for admitting high temperature steam into the inner cylinder for effecting rotation of the turbine blade stages. Steam exit means emits cooled steam from the inner cylinder into a space between the inner and outer cylinders, and steam exhaust means exhausts steam to external of the outer cylinder. A shield reduces thermal stress on the inner cylinder caused by contact on an inner surface with the high temperature steam and contact on an outer surface with the cooled steam. The thermal shield is attached to the outer surface of the inner cylinder and spaced therefrom by a predetermined spacing. The thermal shield extends about all surfaces of the inner cylinder and forms a substantially closed inner space between the shield and the inner cylinder for preventing a flow of cooled steam over the outer surface of the inner cylinder. The thermal shield is preferably formed of stainless steel to minimize the aforementioned corrosion, erosion, and pitting.

In one form, the thermal shield forms an abutting joint against the steam inlet means. The abutting joint is formed by positioning a shield support approximately adjacent the steam inlet means for supporting the shield adjacent the inlet means. A relatively narrow strip of shield material is positioned in abutting contact with the inlet means and the strip is welded to the shield to provide a closed joint. The shield is preferably formed of a plurality of sections of shield material, with each section being supported from the inner cylinder outer surface by a plurality of predeterminately positioned spacers. Each section is joined to an adjacent section to form a continuous shield over the inner cylinder. The spacers comprise a welding stud having one end attached to the inner cylinder and a second end threaded for receiving a fastening screw. The shield includes a plurality of holes alignable with the second ends of the studs and being held in position by the screws, each of the screws being torqued to a predetermined torque value sufficient to prevent vibration of the shield while allowing thermal expansion of the shield. The shield sections are overlapped at adjacent edges with the studs being positioned to coincide with the overlapping edges for fastening the overlapping edges. The predeterminately positioned spacers are arranged with respect to one another at a distance sufficiently small to prevent vibration excitation at a resonant frequency of the shield. A corner joint is formed, in one method, by extending one of the shield sections beyond an abutting mating line with another one of the shield sections at a corner. One of the sections is extended into contact with a surface of the other of the sections so as to deflect the other of the sections to thereby form a tight interface joint. In another method, a corner joint is formed by extending one of the sections beyond an abutting mating line with another of the sections at a corner, then extending the another of the sections into contact with a surface of the one of the sections and welding the one of the sections to the another of the sections at the joint. To accommodate thermal expansion and to prevent loosening of the connections to the studs, the threaded end of each of the screws comprises selflocking deformable threads and the thermal shields are attached to the studs under a controlled preload.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
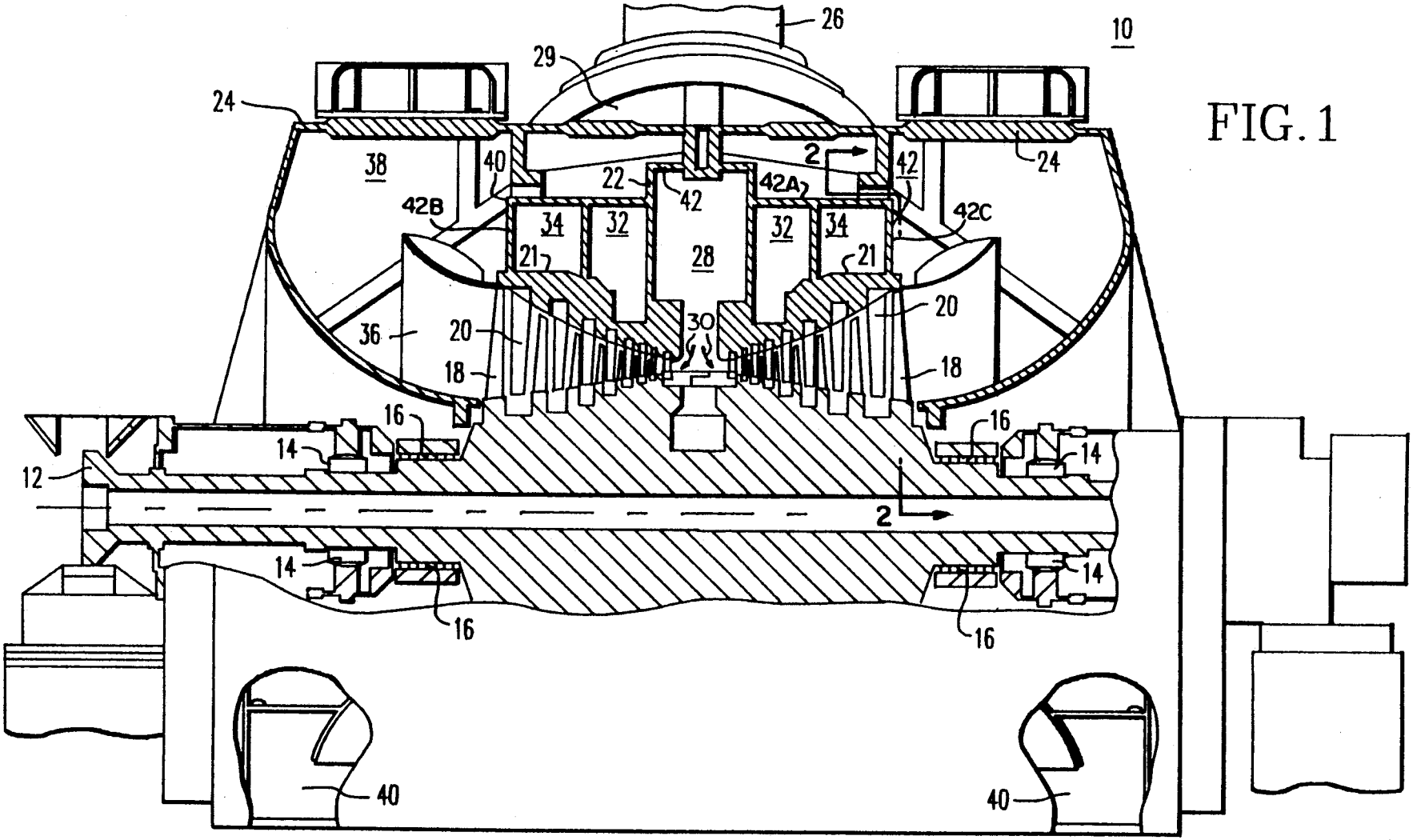
FIG. 1 is a simplified cross-sectional drawing of an exemplary double cylinder low pressure steam turbine.

Referring now to FIG. 1, there is shown a simplified cross-sectional drawing of a low pressure steam turbine 10. The steam turbine includes a shaft 12 passing through the turbine and supported at each end by bearing supports and seal assemblies 14 and 16, respectively. A plurality of turbine blade stages 18 are connected to the shaft 12. Between the turbine blade stages there is positioned a plurality of nonrotating turbine nozzles 20. The turbine blades 18 are connected to the turbine shaft while the turbine nozzles 20 are connected to support members 21 attached to an inner shell or cylinder 22 surrounding the turbine blades and nozzles. The inner cylinder 22 is supported within an outer shell or cylinder 24. Steam inlet means 26 is provided for connecting to a source of high temperature steam (not shown) and directs the steam into a first chamber 28 within the inner cylinder through a passage 29 in the outer cylinder. From the chamber 28, high temperature steam passes into the nozzle flow path, as indicated by the arrows 30, going bidirectionally along the turbine shaft. As steam is directed into the turbine blades, it causes rotation of the blades and the turbine shaft 12. Some of the steam is admitted into additional extraction chambers 32 and 34 and a predetermined amount of steam is intentionally piped off to various feedwater heaters (not shown). After the remaining steam passes through all of the turbine blading, it exits through steam exit means 36 into the cavity 38 defined between the inner cylinder 22 and outer cylinder 24. From this cavity, the steam flows into exhaust means 40 and is directed back to a condenser (not shown) and then to a reheater and/or boiler (not shown) to be reconverted into steam.

The steam entering the first chamber 28 is typically at a temperature of between about 260° and 388° C. As the steam expands moving through the turbine blades 18 and turbine nozzles 20, it cools to the point at which the steam exiting the exit means 36 and accumulating in the cavity 38 between the inner and outer cylinder may be in the range of from 15-50° C. The steam in the chambers 32 is typically at a temperature of about 204°-260° C. while the steam in the chambers 34 may be in the range of 65°-94° C. It can be appreciated that the temperature differential of approximately 315° C. over the wall 42 of the first chamber 28 creates a significant thermal stress on this wall. Furthermore, the chamber 32 contains steam which is approximately 205° C. hotter than the steam exiting the turbine section. As previously described, the temperature differential between the steam in the steam chambers 28, 32, and 34 and that in the cavity 38 between the inner and outer cylinders is sufficient to place a significant thermal stress on the cylinder walls and also to create a significant thermal loss. In particular, heat energy is extracted from the relatively hot steam in the steam chambers 28, 32, 34 by the relatively cool steam surrounding the outer surface or wall 42 of the inner cylinder.

In some prior art systems, this thermal stress and heat loss has been somewhat alleviated by enclosing the inner cylinder in a thermal shield. The prior thermal shields have only surrounded the cylindrical outer surface portion 42A of the inner cylinder which extends between the opposite end walls 42B and 42C. The end walls of the inner cylinder have not been protected by a thermal shield. Furthermore, the thermal shields have not been sealed at their ends and have allowed steam to flow under the shield along the surface 42A where heat loss can occur.

Figure 2:
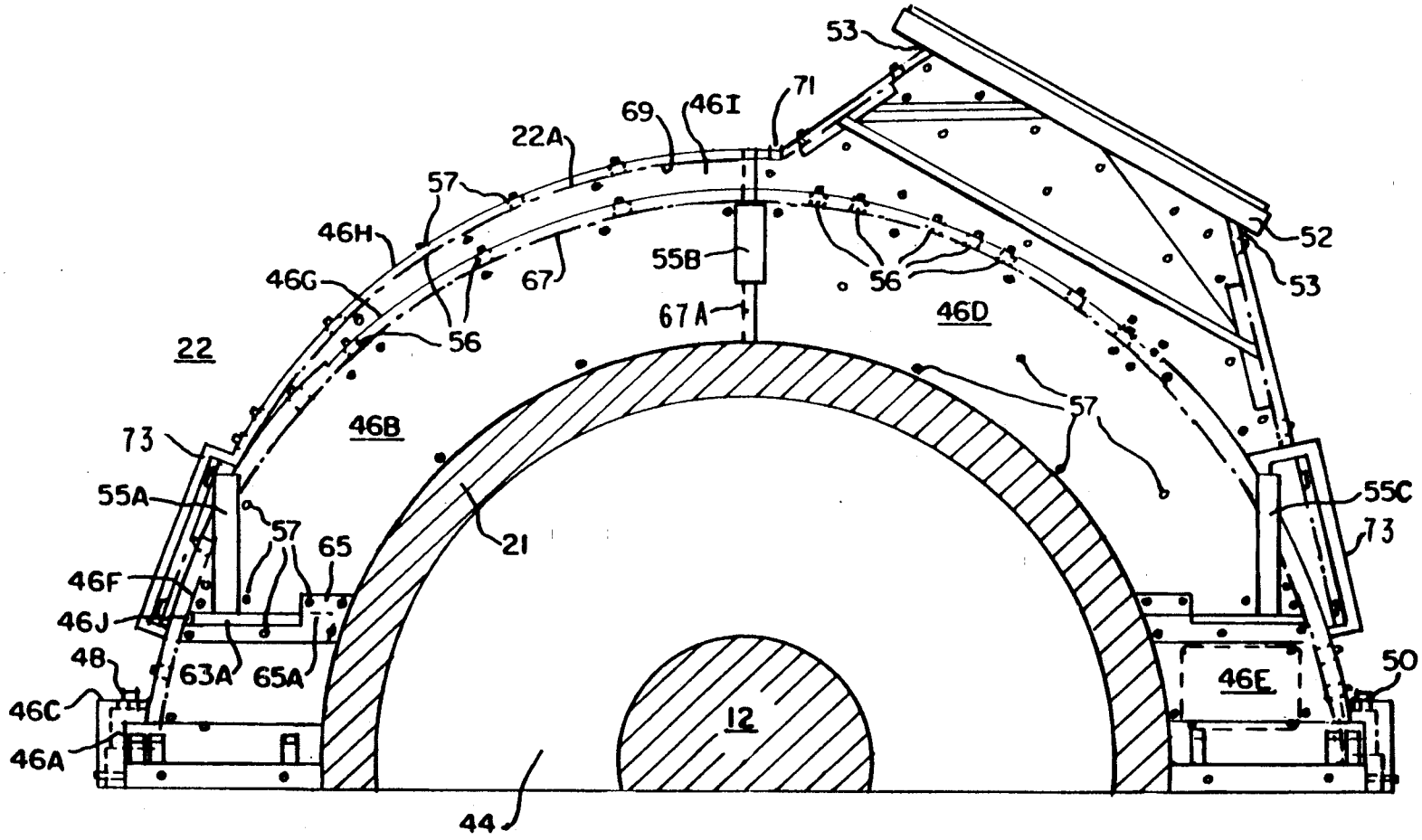
FIG. 2 is a simplified partial end view taken along line 2—2 of FIG. 1 and showing an inner cylinder of a steam turbine incorporating a thermal shield according to the teaching of the present invention.
Figure 7:
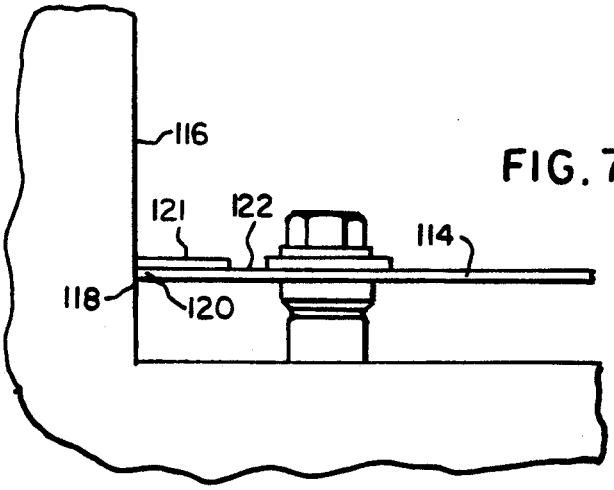
FIG. 7 illustrates still another form of sealing joint according to the present invention.

Turning now to FIG. 2, there is shown an end view of a turbine inner cylinder 22 such as that illustrated in FIG. 1 in which an outer thermal shield 46, whose sections are designated 46A—46J in accordance with the present invention has been installed. This view is taken parallel to the end wall 42C along line 2—2 cutting through the nozzle vane shroud or support member 21 and the shaft 12. Some of the inner cylinder structure has been omitted in order to simplify the description since such structure is not a part of the invention. The area indicated at 44 contains the vanes 20 and blades 18. Only the top half of the inner cylinder is shown since the bottom half is substantially identical. In the end view of FIG. 2, it can be seen that the thermal shield 46 encloses each and every element of the inner cylinder 22, including the elements or clamp nuts 48 and 50 which clamp the upper half of the inner cylinder to the lower half, except for the lifting lugs 55A, 55B, and 55C. The thermal shield 46 extends around the inner cylinder and abuts the steam inlet means 52 in a tight joint 53 so as to minimize any flow of steam under the thermal shield and to provide a substantially closed or dead space under the shield between it and the inner cylinder surface 22A. One form of an abutting joint 53 used about the steam inlet means is shown in FIG. 7. The shielding 46 is supported and spaced from the inner cylinder surface 22A by a plurality of welding studs 56 each having a tapped aperture for receiving a self-locking screw 57. The end wall 42C is covered by a plurality of sections of thermal shield 46. The arrangement of some of these sections will become apparent from the detailed views described hereinafter. For the moment, starting with the lower left-hand connecting flange 61, a shield section 46A overlays this flange and extends upward over the flange nuts 58 to a preselected distance where the shield section bends at approximately 90° toward the end wall 42C. At a selected spacing from the end wall 42C, shield section 46A again bends at 90° and extends parallel to the end wall. Immediately above this last transition, a base 63A protrudes outward from the inner cylinder 22. The base 63A is part of the lifting lug 55A. Just below base 63, the end surface of the inner cylinder jogs inward such that it is desirable to change the orientation of section 46A. Rather than form two more bends, section 46A is bent once and butts against an intermediate section 46J. Since this base 63A extends nearly across the full width of the arcuate surface 42C between the outer circumference of the inner cylinder and the support member 21, it is convenient to form the lower intermediate shield section 46J separately from the next higher shield section 46B. A portion of the section 46J abuts a lower surface of the base 63A and forms a butt joint which may be of the type shown in FIG. 7. Another portion of the section 46A overlaps a portion of section 46B as shown at 65 where the lower dashed lines 65A indicate an underlying edge of section 46B. The overlapping joint 65 may be of the type shown in FIG. 5.

Figure 5:
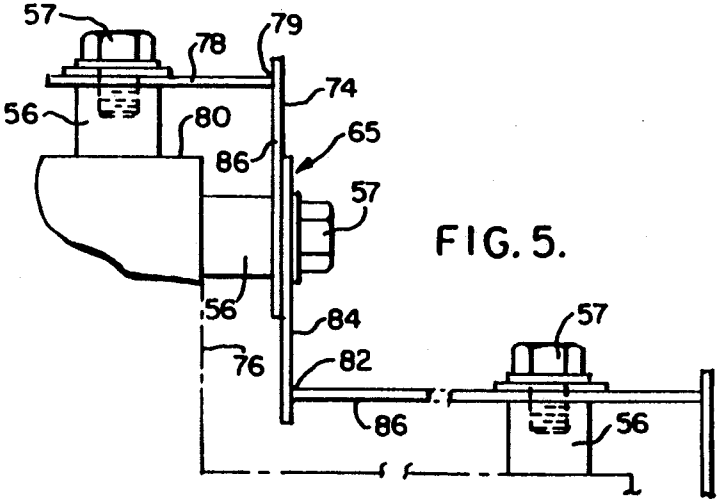
FIG. 5 illustrates one form of sealing joint according to the present invention.

The shield section 46B extends arcuately from the lifting lug 55A and base 63A to the lifting lug 55B. Both shield section 46B and section 46A form a butt joint around the outer surface of shroud member 21. Shield section 46B also forms a butt joint at each of the lifting lugs 55A and 55B. Just below lug 55B, section 46B forms an overlapping joint 67A with shield section 46D. As shown in FIG. 5, each overlapping joint is bolted together at one of the welded studs 56, both to provide a tight joint between shield sections and to minimize vibration. Section 46D and section 46E correspond to sections 46B and 46A, respectively, and are not described in detail.

Still another shield section 46F is required to complete the coverage of the cylinder end surface 42C. Section 46F abuts the outside surface of lifting lug 55A and is essentially triangularly shaped with an outside arcuate edge which mates or forms an abutting joint with the arcuate section 46G which extends around the cylindrical outer surface 42A of the inner cylinder 22. The shield sections 46A and 46B (and their counterparts 46D and 46E) also form a similar butt joint with section 46G. FIG. 2 illustrates the coverage of end surface 42C and has been simplified for clarity. The dashed line 67 represents the edge of the outer surface 42A to which the studs 56 are attached, preferably by welding. Behind the line 67 is a second line 69 which represents an edge of the outer surface of the portion of the inner cylinder containing the chamber 28. By reference to FIG. 1, it can be seen that this chamber 28 extends radially outward beyond the chambers 32, 34 and further is coupled to steam inlet 26. The outer surface of chamber 28 is covered by shield section 46H up to joint 71 where the inlet 26 is attached. The end surface of chamber 28 is covered at least partially by arcuate shield section 46I which abuts section 46H and section 46G. The form of joint between sections 46G and 46I may be that shown at 82 in FIG. 5. The joint between sections 46I and 46H may be that shown at 79 in FIG. 5. This latter joint type also is used between sections 46G and 46B (and 46F, 46A).

Around the steam inlet 26, the joints are typically overlapping between shield sections and abutting where a shield section terminates at a flange or other surface. While reference to FIGS. 5, 6A, 6B, and 7 will illustrate the detail arrangement of various joints, additional insight may also be had by reference to the enlarged sectional views of FIGS. 4A–4B. However, before referring to these details, brief reference is now made to FIG. 3.

Figure 3:
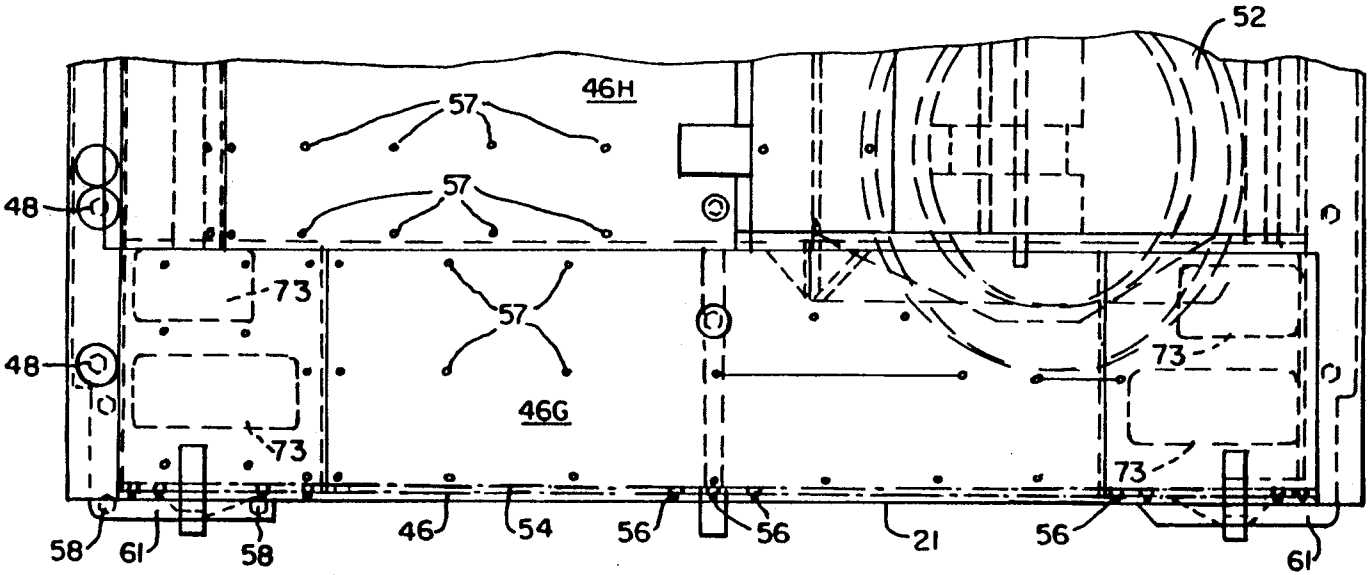
FIG. 3 is a partial plan view of the cylinder of FIG. 2.

FIG. 3 is a plan view of the forward end of the inner cylinder 22 of FIG. 2 showing how the thermal shield 46 extends over the forward end wall 42C of the inner cylinder. The steam inlet flange 52 (see FIG. 2) can be seen as a circular inlet and is indicated in this view in dashed lines to distinguish it from the thermal shielding indicated in solid lines. Similarly, other elements of the inner cylinder 22 are indicated by broken lines, such as the access covers 73. The screws 57 can be seen to be uniformly spaced over the main portions 46G, 46H of the shield. Some of the welding studs 56 on the front surface 54 are visible in this view.

Figure 4A:
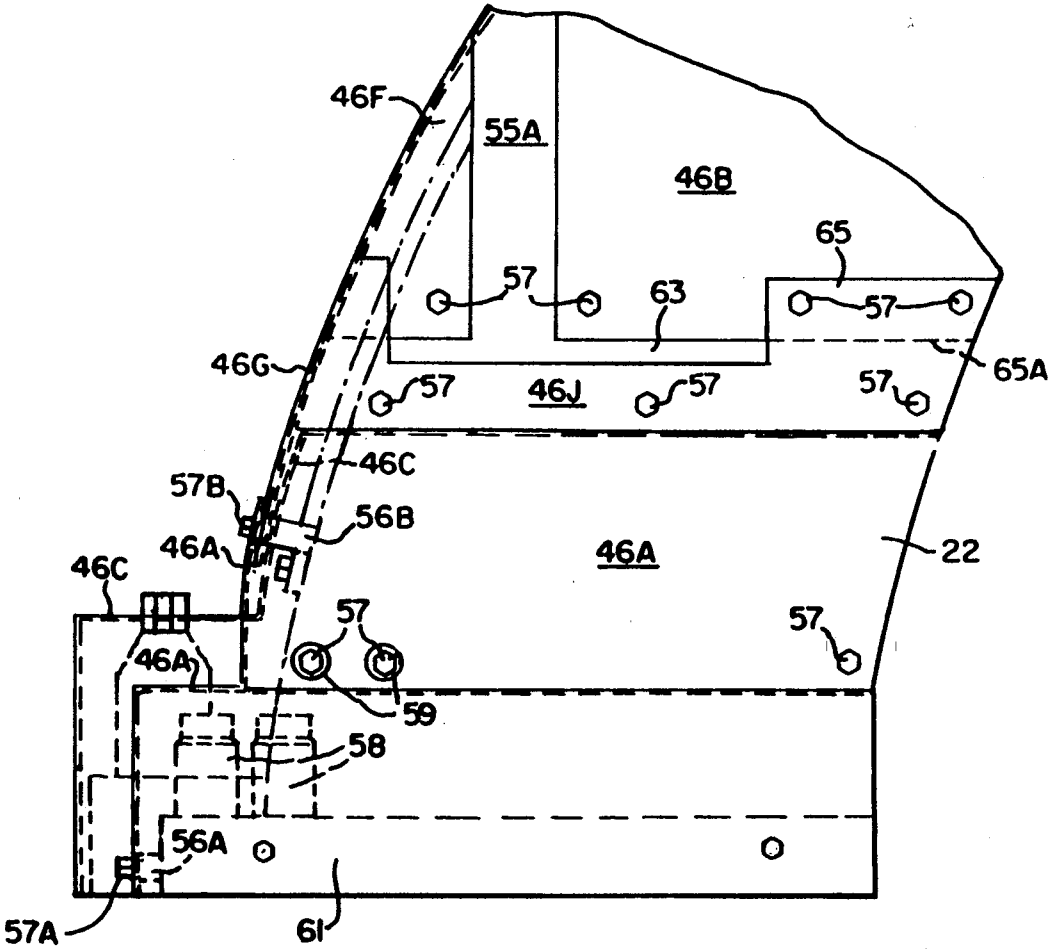
FIG. 4A is an enlarged view of a portion of FIG. 2.

FIG. 4A is an enlarged view of the lower left hand corner of the inner cylinder 22 illustrated in FIG. 2 and shows in greater detail three thermal shield sections 46A, 46B, and 46C used to enclose the inner cylinder and the shield section connections at various mounting studs wherein the screw heads are indicated generally at 57. Some of the screws 57 may be installed with flat washers 59 where only a single thickness of plate or shielding 46 exists. The lower shield section 46A is attached by screw 57A at its lower left end to a stud 56A on the flange 61 of the inner cylinder 22. The section 46A extends upwardly and is bent around the flange nuts 58 on the horizontal joint flange 61 of the inner cylinder to thereby maintain a predetermined spacing between the shield section and the inner cylinder wall. The section 46A continues along the arcuate outer surface 67 until it reaches stud 56B at which point an overlapping joint is formed with the thermal shield section 46G. Each of the shield sections 46A and 46G have holes that align with the stud 56B when the shield sections are properly positioned whereby a bolt or self-locking screw 57B may pass through the holes and be used to attach the shield sections in an overlapping joint arrangement to the stud 56B. Shield section 46C overlaying the lower portion of the outer surface of chamber 28 passes behind the shield section 46A as indicated by the broken lines as the sections cross. Again, for clarity, some turbine elements have been omitted from this view. In particular, the section 46C extends upward until reaching the access cover 73 (see FIG. 2) and additional sections may be used to encompass the access cover. For simplicity, section 46C is shown simply to terminate in FIG. 4A and the access cover is omitted.

Figure 4B:
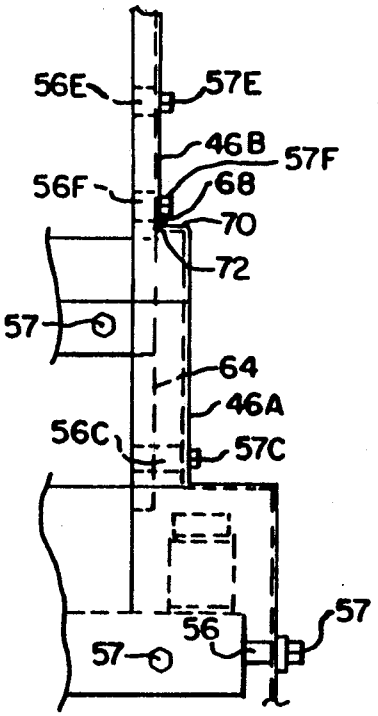
FIG. 4B is a view transverse to that of FIG. 4A.

FIG. 4B is a view taken transverse to the view in FIG. 4A and illustrates how shield section 46A extends over the front surface adjacent flange 61 and end 42C of the turbine inner cylinder 22. In particular, the shield section 46A is attached by means of a plurality of welding studs 56 and corresponding screws 57 spaced about the forward surface 64. One welding stud 56C and screw 57C are shown adjacent the flange 61. A joint 68 is formed by bending an edge 70 of the shield section 46A at a right angle and bringing it into contact with an extension 72 of intermediate curved shield section 46J. The shield section 46B is fastened to the inner cylinder 22 by means of additional studs 56 and screws 57, two of which are indicated generally at 56E, 56F, and 57E, 57F. In the view illustrated in FIG. 4A, it can be seen that there is a plurality of studs 56 which are spaced about the inner cylinder 22 for attaching the shield sections 46 to the inner cylinder. The spacing between the studs 56 is selected such that the length of an extent of a shield section between adjacent studs is sufficiently short to prevent vibration excitation of the shield at undesirably low natural resonant frequencies. The studs 56 used to attach the shield to the inner cylinder are welded and tapped studs of a type well known in the art. The studs are welded to the inner cylinder and are provided with a threaded aperture at their outer ends for receiving a bolt or screw 57 for attaching the shield sections to the studs. Preferably, each of the bolts 57 are torqued to a predetermined torque such as, for example, between 12.5 and 30 ft-lb (1.7 and 4.15 Kg-M), which allows for thermal expansion of the shield sections while insuring that the shield is securely seated on each of the welded studs.

FIG. 4A also shows that the front surface shield sections 46A, 46B, 46F, 46J overlap the outer shield section 46G. The broken lines 75 represent the edges of the shield section 46G hidden behind the aforementioned sections. The form of joint may be of the type shown at 79 in FIG. 5.

While the inner cylinder of a double shell steam turbine may assume various different configurations, the construction of a shield formed of a plurality of sections designed to cover all of the external surfaces of the inner cylinder will be readily apparent from the disclosure of this invention. However, one of the significant features of Applicant's invention is the arrangement of different types of joints for minimizing steam leakage about the abutting edges of the various sections of shielding. Referring now to FIG. 5, there is shown an illustration of one form of joint for traversing inner and outer 90° corners. For an outer corner, a shield section 74 is attached by a plurality of welding studs 56 to a surface 76 of the inner cylinder 22. The shield section 74 extends slightly beyond the plane of a shield section 78 which is attached to another surface 80 of the inner cylinder by means of other studs 56. The length of the shield section 78 between the adjacent stud 56 and the shield section 74 is selected to be slightly greater than the actual distance between the shield section 74 and the same stud 56 in order that an outward directed force may be applied to the shield section 74 by an edge of shield section 78. This outwardly directed force causes a slight deflection of the shield section 74 and maintains a tight fit at the joint 79 due to the elastic nature of the shield material A similar type of joint can be formed for the inside corner at 82 by extending a shield section 84 slightly below the plane of an adjoining shield section 86. The shield section 86 is also formed with a length slightly greater than the actual distance between an adjacent mounting stud 56 and the shield section 84. This also causes the shield section 84 to slightly deflect so that its elastic reaction is to maintain a pressure against the end of the shield section 86 to thereby provide a continuous tight seal at corner 82.

FIG. 5 also illustrates another type of joint utilized for joining adjacent sections of shield such as the shield section 74 and the shield section 84. In the joint 86, the ends of the shield sections 74 and 84 overlap at one of the studs 56 and are bolted together to thereby establish a tight joint Even though some sections joined in this overlapping manner may be at the same spacing from an adjacent surface of the inner cylinder, the flexibility of the shield material allows one section to be deflected sufficiently to form an overlapping joint.

Figure 6A:
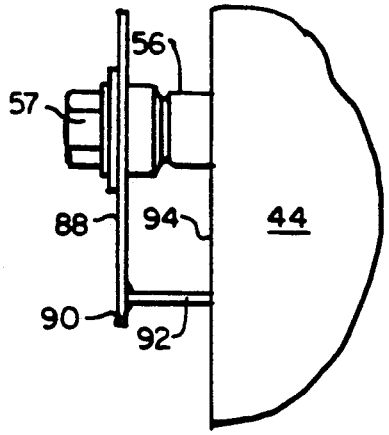
FIGS. 6A and 6B illustrate other forms of sealing joints according to the present invention.
Figure 6B:
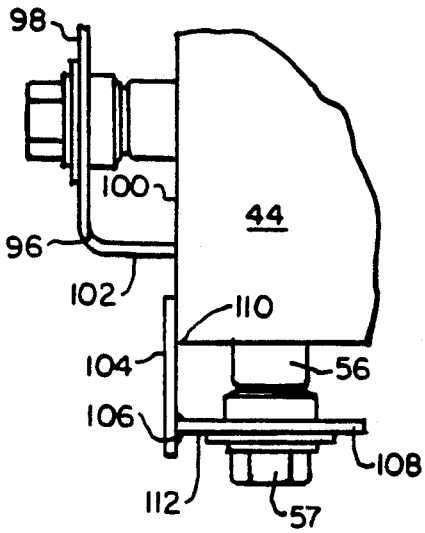

FIGS. 6A and 6B illustrate other forms of joints for maintaining a closed space between a thermal shield and an inner cylinder of a steam turbine. In FIG. 6A, a shield section 88 is attached to the inner cylinder 22 by a stud 56 and screw 57. At the end 90 of the shield section 88, it is desired to terminate the shield. In order to avoid an open space between the shield and the inner cylinder, a small section 92 may be welded to an underside of shield section 88 with an edge of the section 92 pressing against the inner cylinder 22. The section 92 is preferably slightly longer than the spacing established between the shield and the inner cylinder by the stud 56 so that the shield section near its end 90 is deflected outward whereby its elastic reaction causes the section 92 to be tightly pressed against a surface 94 of the inner cylinder. A similar type of arrangement is shown in FIG. 6B in which an edge 96 of a shield section 98 is bent at a 90° angle so that it presses against a surface 100 of the inner cylinder. Again, the section 102 which is bent perpendicular to the surface 100 of the inner cylinder is desirably longer than a nominal spacing between the shield section 98 and the inner cylinder 22 so that the deflection of the shield section 98 will maintain pressure against the inner cylinder surface. FIG. 6B also shows another form of edge closure in which a shield section 104 is welded to an end 106 of a shield section 108 and extends down to a corner 110 of the inner cylinder 22. A shield section 112 between a mounting stud 56 and the shield section 104 is shorter than the nominal spacing between the corner 110 of the inner cylinder and the stud 56 so that the short shield section 104 may also be slightly deflected in order to maintain a tight contact at the corner 110.

FIG. 7 shows another form of arrangement in which a shield section 114 is brought into closure against another shield section 116 (or a surface of the inner cylinder 22). In this case, the shield section 114 does not quite reach the section 116 and therefore provides a small gap 118 between the end 120 of shield section 114 and the adjacent section 116. In order to close this small gap, an additional shield strip 121 may be welded to an outer surface 122 of the shield section 114 while the shield strip is held in tight contact against the adjacent surface of shield section 116. This process may also be used in areas where the adjacent cylinder surface may have some irregular shape or be rounded and allows a separate shield strip to be cut to match the irregular shape and then welded to a continuing shield section.

What has been disclosed is a method and apparatus for enclosing an inner cylinder of a double shell steam turbine in such a manner that a closed space is formed between the inner cylinder and a thermal shield. The thermal shield covers all exposed surfaces of the inner cylinder so that the normally cooled steam exiting the inner cylinder does not flow over a surface of the inner cylinder and thereby creates significant thermal stresses in the inner cylinder walls. Furthermore, by providing an enclosed space between the shield and inner cylinder, there is provided an insulating medium in the closed space which reduces the heat transfer from the inner cylinder to the space between the inner cylinder and outer cylinder and therefore improves the heat rate of the steam turbine. In turbines in which there are provided two inner cylinders and an outer cylinder, the shield would be placed about the innermost cylinder.

While the invention has been described in what is presently considered to be a preferred embodiment as applied to one form of steam turbine, it will be apparent that many modifications and variations may be made in the form of the invention. It is intended therefore that the invention not be limited to the specific embodiment illustrated but be interpreted within the full spirit and scope of the appended claims.

What is claimed is:

1. A steam turbine comprising an inner cylinder surrounding a plurality of turbine blade stages and having an outer cylinder substantially enclosing said inner cylinder, steam inlet means connected to said inner cylinder and extending through said outer cylinder for admitting high temperature steam into said inner cylinder to effect rotation of said turbine blade stages, steam exit means for emitting cooled steam from said inner cylinder into a space between said inner and outer cylinders, and steam exhaust means for exhausting steam externally of said outer cylinder, means for reducing thermal stress on said inner cylinder from contact on an inner surface with the high temperature steam and contact on an outer surface with the cooled steam, said thermal stress reducing means comprising a thermal shield attached to said outer surface of said inner cylinder and spaced therefrom by a predetermined spacing, said thermal shield extending about substantially all exposed surfaces of said inner cylinder and forming a substantially closed inner space between said shield and said inner cylinder to prevent the flow of the cooled steam over said outer surface of said inner cylinder.

2. The steam turbine of claim 1 wherein said thermal shield is formed of stainless steel.

3. The steam turbine of claim 1 wherein said thermal shield forms an abutting joint against said steam inlet means, said abutting joint being formed by positioning a shield support approximately adjacent said steam inlet means for supporting said shield adjacent said inlet means, positioning a relatively narrow strip of shield material in abutting contact with said inlet means and welding said strip to said shield.

4. The steam turbine of claim 1 wherein said shield is formed of a plurality of sections of shield material, said sections being supported from said inner cylinder outer surface by a plurality of predeterminately positioned spacers, each section being joined to an adjacent section and abutting all protuberances to form a continuous shield over said exposed surfaces of said inner cylinder.

5. The steam turbine of claim 4 wherein each of said spacers comprises a stud having one end attached to said inner cylinder and a second end tapped for receiving a fastening screw or bolt, said shield including a plurality of holes alignable with said second ends of said studs and being held in position by said screws, each of said screws being torqued to a predetermined torque value sufficient to prevent vibration of said shield while allowing thermal expansion of said shield.

6. The steam turbine of claim 5 wherein said shield sections are overlapped at adjacent edges thereof, said studs being positioned to coincide with said overlapping edges for fastening said overlapping edges.

7. The steam turbine of claim 5 wherein said predeterminately positioned spacers are arranged with respect to one another at a distance sufficiently small to prevent vibration excitation at a resonant frequency of said shield.

8. The steam turbine of claim 5 wherein a corner joint is formed by extending one of said sections beyond an abutting mating line with another one of said sections at a corner and extending said another one of said sections into contact with a surface of said one of said sections, said another one of said sections being extended a distance sufficient to slightly deflect said one of said sections to thereby form a tight interface joint.

9. The steam turbine of claim 5 wherein a corner joint is formed by extending one of said sections beyond an abutting mating line with another of said sections at a corner, extending said another of said sections into contact with a surface of said one of said sections and welding said one of said sections to said another of said sections at said joint

10. The steam turbine of claim 5 wherein said thermal shields are attached to said studs under a controlled preload.

* * * * *